US005803383A

United States Patent [19]

Boekels

[11] Patent Number: 5,803,383

[45] Date of Patent: Sep. 8, 1998

[54] METHOD FOR AVOIDING CONSTANT PATTERN WINDINGS IN WINDING YARN PACKAGES

[75] Inventor: Lothar Boekels, Mönchengladbach, Germany

[73] Assignee: W. Schalfhorst AG & Co., Moenchengladbach, Germany

[21] Appl. No.: 772,694

[22] Filed: Dec. 23, 1996

[30] Foreign Application Priority Data

Dec. 22, 1995 [DE] Germany ..... 195 48 257.3

[51] Int. Cl.[6] ..... B65H 54/38

[52] U.S. Cl. ..... 242/18.1

[58] Field of Search ..... 242/18.1, 43.1

[56] References Cited

U.S. PATENT DOCUMENTS

| | | | |
|---|---|---|---|
| 3,402,898 | 9/1968 | Mattingly | 242/43 |
| 3,638,872 | 2/1972 | Jennings | 242/18.1 |
| 3,910,514 | 10/1975 | Hooper | 242/18.1 |
| 4,060,208 | 11/1977 | Raasch | 242/18.1 |
| 4,296,889 | 10/1981 | Martens | 242/18.1 |
| 4,345,721 | 8/1982 | Derail | 242/18.1 |
| 4,349,160 | 9/1982 | Niederer | 242/18 R |
| 4,504,024 | 3/1985 | Gerhartz | 242/18.1 |
| 4,667,889 | 5/1987 | Gerhartz | 242/18.1 |
| 4,913,336 | 4/1990 | Lenz | 242/18.1 |

FOREIGN PATENT DOCUMENTS

| | | |
|---|---|---|
| 25 34 239 C2 | 7/1975 | Germany . |
| 28 55 616 A1 | 12/1978 | Germany . |
| 43 37 891 A1 | 11/1993 | Germany . |

*Primary Examiner*—Daniel P. Stodola
*Assistant Examiner*—Tina R. Taylor
*Attorney, Agent, or Firm*—Kennedy Covington Lobdell & Hickman, LLP

[57] ABSTRACT

A method of avoiding constant pattern windings when winding yarn packages by driving traversing yarn guides in accordance with a periodic disruption function, wherein the magnitude of the slope of the periodic disruption function in the vicinity of the extreme points of the function is greater in comparison than the magnitude of the slope of a corresponding sine function having the same amplitude and period. Moreover, the magnitude of the slope of the periodic disruption function changes at least once between a zero crossover and an extreme point, whereafter, until the vicinity of the extreme point is reached, the magnitude of the slope of the periodic disruption function is less than the magnitude of the slope of the corresponding sine function having the same amplitude and period. Preferably, the amplitude and period of the periodic disruption function of the present invention is also randomly varied periodically. Moreover, in a polygonal periodic disruption function of the present invention, the salient points per half period of the polygonal function are preferably randomly changed periodically.

15 Claims, 4 Drawing Sheets

METHOD FOR AVOIDING CONSTANT PATTERN WINDINGS IN WINDING YARN PACKAGES

FIELD OF THE INVENTION

The present invention relates to a method for avoiding constant pattern windings in the winding of yarn packages and, in particular, to the varying of the speed of traversing yarn guides between maximum and minimum speeds in accordance with periodic disruption functions having certain characteristics.

BACKGROUND OF THE INVENTION

In a yarn package winding process, a winding drum typically drives the circumference of yarn packages at a constant circumferential speed and yarn is directed onto the yarn package by yarn guides which traverse the yarn packages. Because the yarn packages are individually driven by a common winding drum, each yarn package revolution speed depends directly on the diameter of the yarn package bobbin and the corresponding yarn wound on the bobbin; specifically, changes in the package revolution speed are inversely proportional to changes in the yarn package diameter. Consequently, as the yarn package is wound and the diameter thereof increases, a winding ratio of the package revolution speed to the double stroke rate of the traversing yarn guide continually changes.

Constant pattern windings occur during the yarn package winding process whenever the winding ratio comprises a whole number, at which time the yarn is placed several times by the traversing yarn guide at the same or neighboring location on the yarn package, leading to tape-like yarn layers. These constant pattern windings have negative effects on subsequent processes involving the yarn packages and should be avoided. For instance, constant pattern windings interfere with the subsequent unwinding of yarn packages when drawing off complete yarn layers.

In conventional open-end spinning machines all winding devices and all traversing yarn guides are each centrally driven. Because of the plurality of yarn packages which are centrally driven in such conventional machines and because of the various possible winding states of each yarn package, it is impossible to individually apply a pattern disruption to each winding state of each yarn package; the pattern disruption needs to be effective, regardless of the winding ratio at each individual winding station.

To avoid constant pattern windings, it is therefore known to vary or disrupt, in accordance with certain periodic functions, the double stroke rate of the traversing yarn guides for the plurality of winding stations. A method and a device for such pattern disruption in a machine for producing yarn packages and having traversing yarn guides to which the yarn is supplied at a constant speed is known from German Patent Publication DE 25 34 239 C2. The described basic periodic disruption functions for generating pattern disruptions in the reference are the rectangular function, according to which yarn guides are driven only at alternating minimum and maximum speeds, and the sine function, according to which yarn guides are accelerated between minimum and maximum speeds in an oscillating pattern corresponding to a sine wave. Specifically, the disruption functions disclosed by this reference represent the speeds at which the yarn guides are driven as a function of time, and the derivative or slope of each function at any specific time indicates the acceleration of the yarn guides at that time.

In addition to the rectangular disruption function and the sine disruption function, it is also known to use the triangular function and the sawtooth function for generating pattern disruptions. Moreover, because these functions are repetitive, i.e., the speeds of the yarn guides varying back and forth between minimum and maximum speeds, these functions are also known as periodic disruption functions.

The quality of pattern disruptions for a particular function during random winding can be recognized by the way the yarn layers are distributed, i.e., how the yarn layers, which otherwise would rest on top of each other in a pattern, are instead spread over the bobbin surface. This placement can be recognized by the distribution of the reversing points of the yarn at the ends of the bobbin itself. For example, the quality of pattern disruption resulting from the triangular, sawtooth and sine functions is not very good, in that these functions result in large angular areas of the circumference of the bobbin ends lacking reversing points of the yarn. Thus, continuously wandering areas, i.e., angular areas of the circumference of the bobbin ends in which no yarn is deposited during a large number of bobbin turns, are distributed about the circumferential surface of the yarn package. Consequently, the structure of such yarn packages is inhomogeneous even though a pattern build-up is otherwise prevented.

An improved distribution of the yarn reversing points on the circumference of the bobbin ends is exhibited by the rectangular function. In comparison, an angular area lacking in yarn reversing points of around 210° results from the triangular function, whereas an angular area of around only 70° results from the rectangular function.

The rectangular function does have its disadvantages, however. Notably, it is possible that since the double stroke rate exhibited by the rectangular function in the extreme points remains constant over a predetermined time, and since the diameter of the yarn package continues to increase, the winding ratio of a whole number may occur during the predetermined time resulting in an uninterrupted pattern build-up. This pattern build-up occurs because of the constant drive speed of the rectangular function in this area.

OBJECT AND SUMMARY OF THE INVENTION

It is therefore an object of the present invention to provide a method of avoiding constant pattern windings which is more effective than the aforementioned methods which utilize the sine function, triangular function, sawtooth function, and rectangular function.

This object is attained in accordance with the method of the present invention by accelerating all and every traversing yarn guide between an extreme maximum traversing motion speed and an extreme minimum traversing motion speed in accordance with a periodic disruption function which, when plotted against time and in comparison with a sine function having the same amplitude and period, includes:

a. at the arithmetic mean of the extremities, a slope having a magnitude greater than the corresponding magnitude of the slope of the sine function, b. in the vicinity of the extremities, a slope having a magnitude greater than the corresponding magnitude of the slope of the sine function, and c. wherein, between each arithmetic mean and the following extremity, the slope is changed at least once so that, between the change in slope and the area in the vicinity of the extremity, the periodic disruption function includes a slope having a magnitude that is less than the corresponding magnitude of the slope of the sine function.

Mathmatically speaking, the method of the present invention includes the steps of driving in periodic manner the traversing yarn guide at speeds between a maximum speed ($V_{mean}$+v) and a minimum speed ($V_{mean}$−v) in accordance with a periodic function V(t) having a period L and angular frequency ω equal to (2π/L), wherein:

a. the speed of the yarn guide at time $t_0$ is equal to $V_{mean}$;

b. the speed of the yarn guide at time equal to ($t_0$+L/4) is $V_{mean}$+v, where v is the amplitude of the periodic disruption function V(t);

c. the speed of the yarn guide at time equal to ($t_0$+L/2) is $V_{mean}$;

d. the speed of the yarn guide at time equal to ($t_0$+3L/4) is $V_{mean}$−v; and e. the speed of the yarn guide at time equal to ($t_0$+L) is $V_{mean}$.

Furthermore, the method also includes the accelerating of the traversing yarn guide at an acceleration V'(t), i.e., the derivative of the periodic disruption function V(t), so that:

a. the magnitude of the acceleration at time equal to $t_0$ is greater than the absolute value of ωv;

b. the limit of the magnitude of the acceleration as the time approaches ($t_0$+L/4) is greater than 0; and c. the magnitude of the acceleration at a time equal to $t_x$ between t=$t_0$ and t=($t_0$+L/4) is less than the absolute value of (ωv multiplied by cos ($\omega t_x$).

Further features of the present invention include the steps of: continuously changing the acceleration of the traversing yarn guide; changing the extreme maximum and minimum speeds; and, accelerating the yarn guide at constant acceleration at least three times in each half period of the disruption function, changing the length of the times at which the yarn guide is driven at constant acceleration, and changing the number of times the yarn guide is accelerated at constant acceleration per half period.

A further feature of the present invention is randomly selecting one of the foregoing features of the present invention using a random generator.

As will now be apparent, the periodic disruption function of the present invention has a slope at the arithmetic mean of the maximum speed and minimum speed which has a magnitude that is greater there than the magnitude of the slope of a sine function which has the same period and amplitude. So that the residence time of the disruption function in the area of the extremities is as short as possible, the slope of the disruption function in the area of the extremities also diverges from the slope of the sine function. Specifically, the periodic disruption function has a slope in the vicinity of the extreme points of a magnitude that is greater than the magnitude of the slope of a corresponding sine function having the same period and amplitude.

Moreover, preferably the magnitude of the slope of the disruption function must change between the arithmetic mean and an extremity at least once so that, from the point of change to the area of the vicinity of the extremity, the magnitude of the slope of the disruption function is less than the magnitude of the slope of the sine function having the same period and amplitude.

Essentially, a periodic disruption function of the present invention lies between the disadvantageous triangular function and the disadvantageous rectangular function discussed above. Moreover, the periodic disruption function of the present invention can either be realized by a curved function or a polygonal function, with the polygonal function comprising straight-line segment sections of different, constant slopes, and having at least three salient points in each half period so that the polygonal function lies between the disadvantageous triangular function and the disadvantageous rectangular function.

Thus, the periodic disruption functions of the present invention can either be realized by curved functions or by polygonal functions, and in the case of traversing yarn guides which are driven by a common independent controllable motor, the respective disruption functions of the present invention can be generated with the aid of a function generator.

The disruption effectiveness of constant pattern windings are further improved in further features of the present invention. Specifically, preferable features of the present invention includes the step of changing the period and the amplitude of the disruption function. The disruption of the pattern winding is even more effective if these two features, i.e., the changing of the period and the changing of the maximum and minimum double stroke rates, are performed simultaneously. Effective disruption of constant pattern windings can also be improved by changing the positions of the salient points of the polygonal functions of the present invention, i.e., altering the times when the constant acceleration of the traversing yarn guides is changed in accordance with a polygonal function of the present invention.

In one preferred way of practicing the present invention, the aforementioned disruption possibilities are selected by a random generator which is connected to a drive of the traversing yarn guides by a controllable motor. The probability of reaching or passing through winding conditions which cause constant pattern windings in spite of the disruption functions of the present invention and the aforementioned variations thereof is clearly minimized thereby.

DETAILED DESCRIPTION OF THE PREFERRED EMBODIMENT

A periodic disruption function in accordance with the present invention can be employed for disrupting the speed of the drive unit for all traversing yarn guides except for yarn-laying reverse thread rollers, which also drive the bobbin at the same time.

The periodic disruption function, by means of which the speed of the drive unit of the traversing yarn guides is disrupted, can be realized by a conventional mechanical gear or by a conventional electronic control unit of the drive unit of the traversing yarn guides. Examples of such control can be found in German Patent Publication DE 25 34 239 C2. Moreover, control of the drive unit of the traversing yarn guides of a textile machine having a plurality of winding devices is more easily achieved if the yarn guides are driven together by one individual motor, whose speed can be continuously controlled, for example, by an asynchronous motor supplied by a current inverter. With the aid of a function generator, disruption functions of the present invention may be generated for interfering with, or changing, the speed of the drive unit of the traversing yarn guides.

Figure 8:
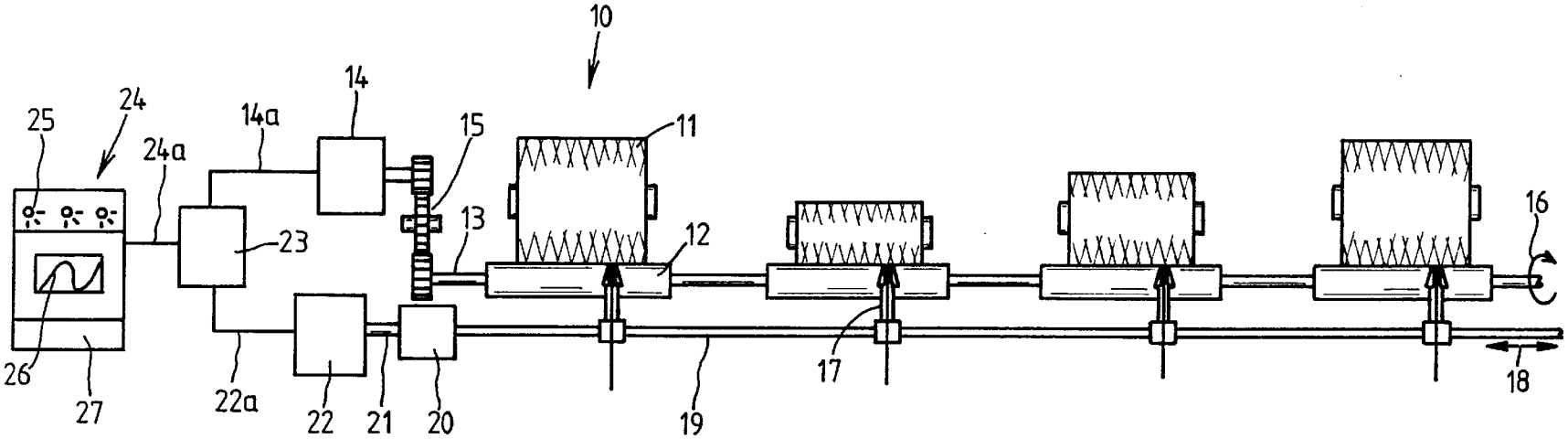
FIG. 8 shows an example of a controlled drive of winding devices and traversing yarn guides with which the present invention may be practiced.

An example for a controlled drive of winding devices and yarn guides is represented in FIG. 8, wherein the winding devices 10 are represented by the yarn packages 11 which are illustrated in different winding states and all of which are respectively seated on a winding rollers 12. The winding rollers 12 are connected with each other by a continuous shaft 13 and are simultaneously driven thereby. Moreover, motor 14 is coupled with the shaft 13 via a gear 15 for driving the winding rollers 12.

While the winding drums 12 turn in the direction of the arrow 16, the traversing yarn guides 17 located in front of the yarn packages are moved back and forth over the width of the yarn packages 11 in accordance with the two-headed arrow 18. All yarn guides 17 are arranged on a continuous yarn guide rod 19. The rotary movement of the motor 22 delivered via the shaft 21 is converted into a back-and-forth movement by a special gear 20.

The rpm of the motor 14 for driving the winding drums 12 and the rpm of the motor 22 for driving the yarn guide rod 19 must be synchronized with each other for compensating any yarn tension that occurs during the back-and-forth movement of the yarn guides 17, and therefore they are connected via control lines 14*a* and 22*a* with a control device 23. A function generator 24 is connected to the control device 23 via a control line 24*a*. The function generator generates disrupting functions in accordance with the present invention, which can be entered into the function generator 24 by way of an input 25. Moreover, the disruption function can be graphically represented on a display 26, and a random generator 27 offers the option of letting disruption possibilities be randomly selected and incorporated into the disruption function of the present invention in accordance with further features of the present invention.

Figure 1:
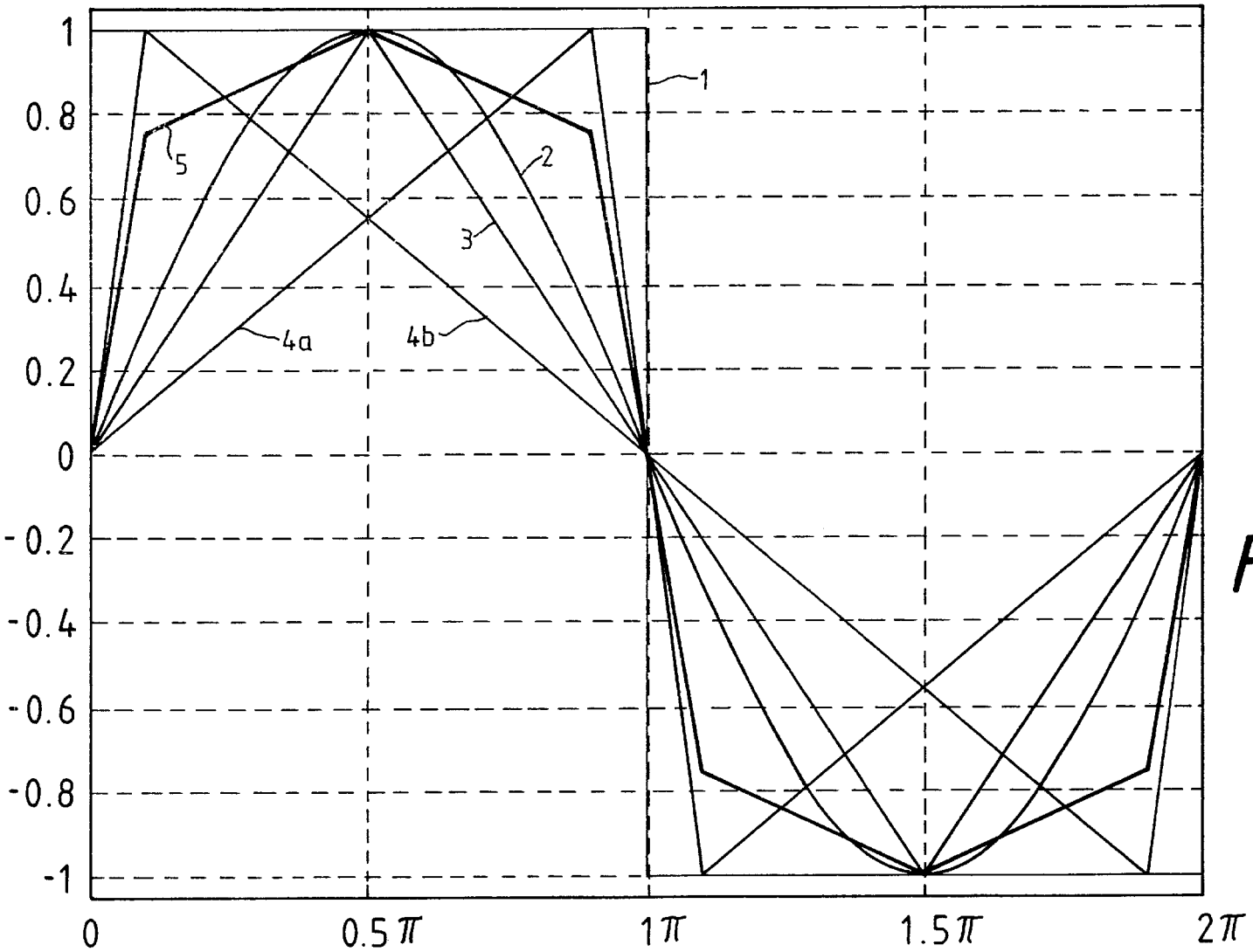
FIG. 1 shows a polygonal disruption function 5 of the present invention contrasted with prior art disruption functions 1,2,3,4*a*,4*b;*

Turning now to periodic disruption functions of the present invention, the curves of a selection of periodic disruption functions over the length of a period are represented in FIG. 1, wherein a polygonal progression 5 in accordance with the present invention is shown. Moreover, for purposes of illustration, prior art rectangular curve 1, prior art sine curve 2, prior art symmetrical triangular curve 3, and prior art mirror-reversed symmetrical sawtooth curves 4*a*,4*b* are also shown, with the period of all the periodic disruption functions being set at $2\pi$ and the amplitude being set at 1.

If in each case the integral over a periodic disruption function of the amplitude 1 within the limits from 0 to $\pi$ is calculated, i.e., over a half period, the following areas result:

| | |
|---|---|
| Rectangular function: | 3.1415 |
| Sine function: | 2.0000 |
| Triangular function: | 1.5708 |
| Sawtooth function: | 1.5708 |
| Polygonal function between the sine function and the rectangular function: | from 2.000 to 3.1415 |

It has been found that the area underneath a curve can be considered as a rough measurement of the effectiveness of the pattern disruption of the individual functions. The quality of the pattern disruptions therefore increases with increased area content. In accordance with this observation, the prior art rectangular function 1 appears to provide the best conditions for pattern disruption, but the long residence time of the rectangular function in the respective extreme points causes the above mentioned disadvantages, and in fact, the polygonal function 5 has been found to be preferable over the prior art functions 1,2,3, 4*a*,4*b*.

Specifically, experimental evidence was taken for the sine function 2, the triangular function 3, and the rectangular function 1, and compared with results for the polygonal function 5. Each function was employed under similar circumstances in order to obtain comparable results for the effects of the pattern disruption functions. Specifically, the amplitude was set at a change of maximally ±5% of the rpm of the drive for the yarn guides, and the period was set so that, during one period of each disruption function, approximately 15 ½ double lifts are completed. The effectiveness of the disruption was simulated at a winding ratio of 2, i.e., two double lifts per bobbin turn, on a cylindrical bobbin with an initial diameter of 167.78 mm. The nominal crossing angle at basic rpm of the yarn guide drive was 33°, the yarn speed was 125.73 m/min, and the bobbin width was 156.6 mm. During the pattern disruption, the crossing angle changed by ±1.65° and the number of double lifts per minute by ±4.87%.

The results of the disruption effects of the above mentioned functions, with the exception of the sawtooth functions, will now be explained by means of FIGS. 2 to 5.

In FIGS. 2 to 5, three periods are shown ahead of each disruption function, which start at a bobbin diameter of approximately 168.2 mm in the zero crossover of the disruption functions, i.e., at the arithmetic mean speed of the drive for the yarn guides. The bobbin diameter is plotted on the abscissa, which at the same time is the time axis, and one full bobbin circumference each is plotted on the ordinate, with a complete bobbin circumference on the ordinate being associated with each diameter on the abscissa. The reversing points per double lift have been sequentially plotted and connected in accordance with their sequence.

Figures 2, 3, 4, 5:
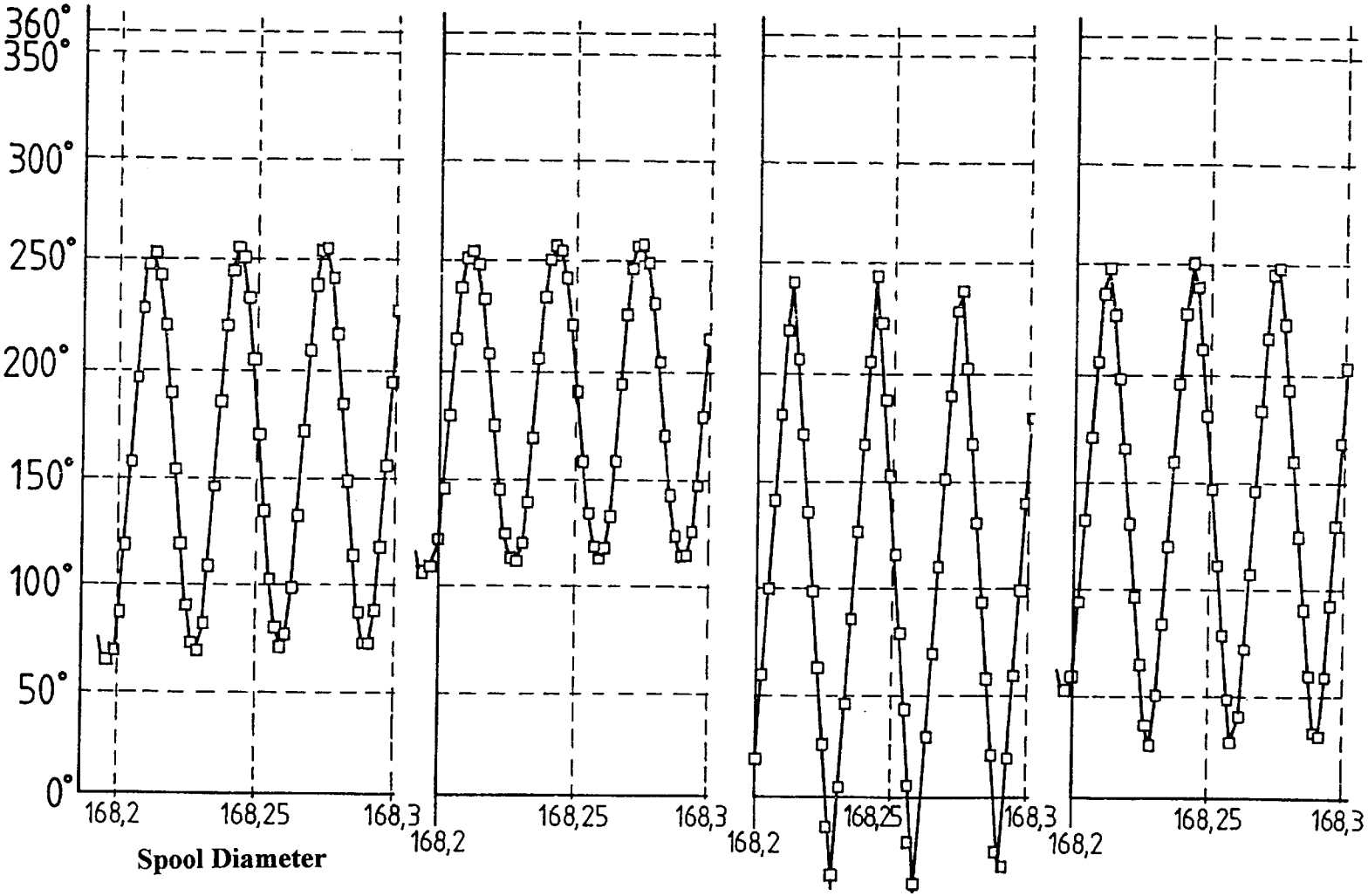
FIG. 2 shows the yarn reversing points resulting from a prior art sine function.
FIG. 3 shows the yarn reversing points resulting from a prior art triangular function.
FIG. 4 shows the yarn reversing points resulting from a prior art rectangular function.
FIG. 5 shows the yarn reversing points resulting from a polygonal function of the present invention.

FIG. 2 represents the disruption effects of a sine function. The zero crossover of the period is located shortly ahead of the bobbin diameter. While the winding ratio during the zero crossover is the whole number 2, i.e., two double lifts per bobbin revolution, and the prerequisites for constant pattern windings are given by this, the intended disruption occurs because of the change of the rpm of the yarn guide drive and thus the change in the lift speed. While during the zero crossover, in this case the extreme points of the diagram curves, the position of two double lifts next to each other can be observed because of the rise of the sine function, the reversing points of each double lift move further away from the zero crossover, and after a half period move closer again, even coincide, at the extreme point of the diagram curve. This means that the beginnings of constant pattern windings on the circumferential surface of the bobbin can be observed analogously with the zero crossovers of the disruption curve. Furthermore, the distribution of the reversing points over the circumference of the yarn package thus formed is unfavorable. The distribution is limited to an angular area of approximately 185°, while an angular area of approximately 175° remains uncovered. This area moves only slowly over the circumference of the yarn package, and an inhomogeneous bobbin structure in the area of the passage through the pattern zones is created.

FIG. 3 represents the disruption effects of a triangular function. Note that in FIG. 1, the triangular function, and with it the area enclosed by it, lies under the sine function. Therefore its disruption quality is less, as can obviously be read from the positional distribution of the reversing points in FIG. 3, wherein the reversing points are distributed over an even smaller angular area of the circumference of the yarn package; an angular area of approximately 150° to 210° lacks reversing points. Because of the even lesser rise of the triangular function in respect to the sine function in the zero crossover, patterns are already created there, because reversing points coincide and are located closely next to each other.

FIG. 4 represents the disruption effects of a rectangular function. The curve progressions extending past the lower edge of the diagram complement the corresponding angular area. The rectangular function has the best disruption effect because of the largest enclosed area. Only approximately 75° of the bobbin circumference have no reversing points. In comparison with bobbins which were wound under the effect of the disruption functions in accordance with FIGS. 2 and 3, the bobbin structure was correspondingly more homogeneous. However, a rectangular function loses its disruption effect and generates patterns itself if, because of the number of lifts of the yarn guide, a whole number winding ratio occurs at the extreme constant speeds (the horizontal lines of the rectangular function).

FIG. 5 represents the disruption effects of a polygonal function in accordance with the invention. The disruption effects of the polygonal function are slightly less than that of the rectangular function because of the smaller area of the polygonal function than that of the rectangular function in FIG. 1. However, the polygonal function is a considerable improvement over the sine function, with the circumferential area of the yarn package which is not covered by reversing points being approximately 130°. The position of the reversing points in the area of the zero crossover is also considerably less close than that exhibited by the sine function and the triangular function. Because of this, there is little danger of constant pattern windings occurring in the area of the zero crossover. Moreover, because the polygonal function does not exhibit the horizontal lines of the rectangular function, there is substantially less risk that a whole number winding ratio will be obtained during winding.

Figure 6:
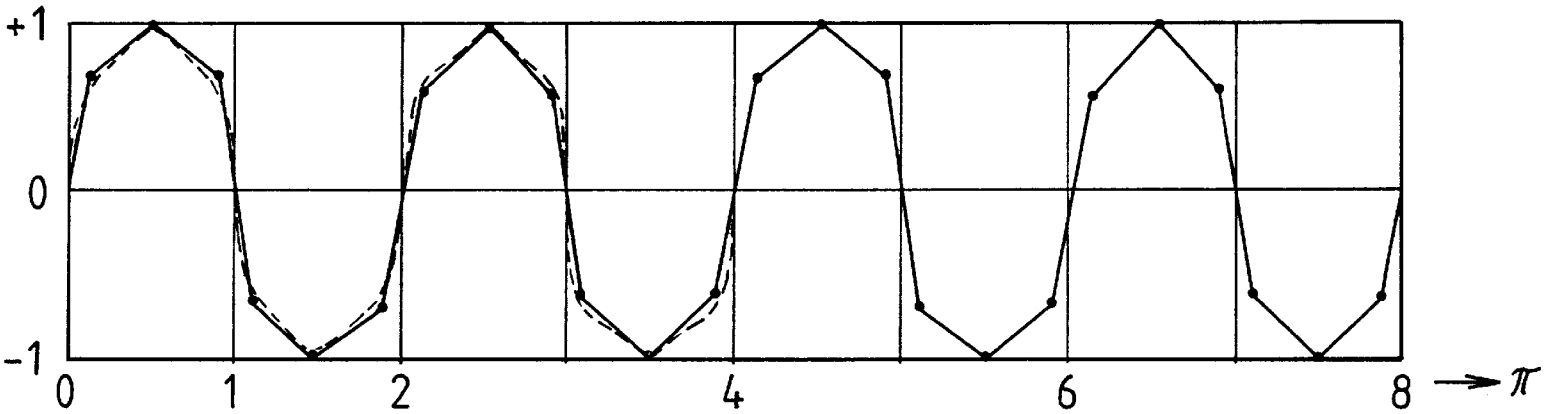
FIGS. 6 and 7 show examples of variations of disruption functions of the present invention.
Figure 7:
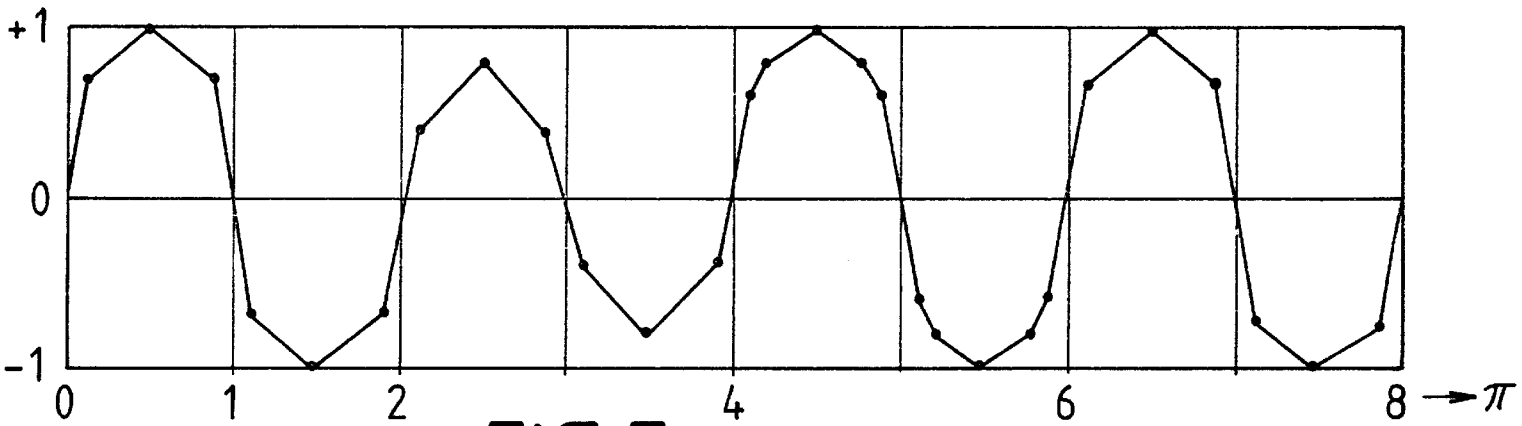

Examples of how the disruption function of the present invention can be changed to further guard against constant pattern windings are shown in FIGS. 6 and 7. In FIG. 6 the position of the salient points of the polygonal function are periodically changed. Specifically, the polygonal function in FIG. 6 has respectively three salient points per half period and is plotted over four complete periods with each period equally $2\pi$, and the amplitude being set at $\pm 1$. A periodic change in the position of the salient points occurs in the second and fourth periods. A curve which illustrates the change in the periods between the first and second periods is shown in dashed lines in FIG. 6.

Further disruption characteristics are illustrated in the polygonal function of FIG. 7, wherein the polygonal function initially has three salient points per half period in the first two periods (0 to $4\pi$), five salient points per half period in the next period ($4\pi$ to $6\pi$), and three salient points per half period in the next period ($6\pi$ to $8\pi$). Moreover, the amplitude and the position of the salient points is changed between the first period (0 to $2\pi$) and the second period ($2\pi$ to $4\pi$).

It will therefore be readily understood by those persons skilled in the art that the present invention is susceptible of a broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A method for avoiding constant pattern windings in the winding of yarn packages on a textile winding machine, comprising the steps of:

i. traversing with a yarn guide at a traversing motion speed yarn being drawn onto a yarn package, and ii. changing the traversing motion speed of the traversing yarn guide by accelerating the traversing yarn guide between an extreme maximum traversing motion speed and an extreme minimum traversing motion speed in accordance with a periodic disruption function, the periodic disruption function, when plotted against time in comparison with a sine function having the same amplitude and period, including:

a. at the arithmetic mean of said extremities, a slope having a magnitude greater than the corresponding magnitude of the slope of said sine function, b. in an interval of time including a said extremity, a slope having a magnitude greater than the corresponding magnitude of the slope of said sine function, and c. wherein, between each said arithmetic mean and the following extremity, the slope is changed at least once so that, between said change in slope and said interval of time, said periodic disruption function includes a slope having a magnitude that is less than the corresponding magnitude of the slope of said sine function.

2. The method according to claim 1, further comprising continuously changing said acceleration of said traversing yarn guide.

3. The method according to claim 2, further comprising changing the period of said periodic disruption function.

4. The method according to claim 2, further comprising changing the extreme maximum and extreme minimum speeds.

5. The method according to claim 1, further comprising accelerating said traversing yarn guide at constant acceleration at least three times in each half period of said periodic disruption function.

6. The method according to claim 5, further comprising changing the period of said periodic disruption function.

7. The method according to claim 5, further comprising changing the extreme maximum and extreme minimum speeds.

8. The method according to claim 5, further comprising changing the length of said times when said traversing yarn guide is accelerated at constant acceleration.

9. The method according to claim 5, further comprising changing the number of times said traversing yarn guide is accelerated at constant acceleration during said half period.

10. The method according to claim 5, further comprising randomly performing at least one of the group of the following steps:

i. changing the length of said times when said traversing yarn guide is accelerated at constant acceleration; and ii. changing the number of times said traversing yarn guide is accelerated at constant acceleration during said half period.

11. The method according to claim 1, further comprising changing the period of said periodic disruption function.

12. The method according to claim 1, further comprising changing the extreme maximum and extreme minimum speeds.

13. The method according to claim 1, further comprising randomly performing at least one of the group of the following steps:

i. continuously changing said acceleration of said traversing yarn guide;

ii. changing the period of said periodic disruption function; and iii. changing said extreme maximum and extreme minimum speeds between which said traversing yarn guide is accelerated.

14. The method according to claim 13, further comprising randomly performing at least one of the group of the following steps:

i. continuously changing said acceleration of said traversing yarn guide;

ii. changing the period of said periodic disruption function; and iii. changing said extreme maximum and extreme minimum speeds between which said traversing yarn guide is accelerated.

15. A method for avoiding constant pattern windings in the winding of yarn packages on a textile winding machine having traversing yarn guides, comprising the steps of:

(i) driving the traversing yarn guides at a periodic speed between a maximum speed ($V_{mean}+v$) and a minimum speed ($V_{mean}-v$) in accordance with a periodic function V(t) having period L and angular frequency ($\omega=(2\pi/L)$, wherein:

a. $V(t_0)=V_{mean}$, b. $V(t_0+L/4)=V_{mean}+v$, c. $V(t_0+L/2)=V_{mean}$, d. $V(t_0+3L/4)=V_{mean}-v$, and e. $V(t_0+L)=V_{mean}$; and (ii) accelerating said traversing yarn guides at an acceleration V'(t) so that:

a. $|V'(t_0)|>|\omega v|$, b. the limit of $|V'(t)|$as $t\rightarrow t_0+(L/4)$ is greater than 0, and c. at a time $t_x$ between $t=t_0$ and $t=t_0+(L/4)$, $|V'(t_x)|<|\omega v \cos(\omega t_x)|$.

* * * * *